US005741963A

United States Patent [19]

Nakatani et al.

[11] Patent Number: 5,741,963

[45] Date of Patent: Apr. 21, 1998

[54] ADJUSTMENT METHOD FOR SPARK PLUG AND APPARATUS THEREFOR

[75] Inventors: Hiroshi Nakatani; Tsutomu Ozawa; Syoiti Umekawa, all of Kuwana; Hirofumi Nishiwaki, Yokkaichi, all of Japan

[73] Assignee: Nippondenso Co., Ltd., Kariya, Japan

[21] Appl. No.: 832,337

[22] Filed: Apr. 3, 1997

Related U.S. Application Data

[63] Continuation of Ser. No. 563,821, Nov. 28, 1995, abandoned.

[30] Foreign Application Priority Data

Nov. 29, 1994 [JP] Japan ..... 6-294673

[51] Int. Cl.[6] ..... H01T 13/20

[52] U.S. Cl. ..... 73/118.1; 445/7

[58] Field of Search ..... 73/118.1; 29/593; 445/7; 348/94, 95, 87

[56] References Cited

U.S. PATENT DOCUMENTS

| | | | |
|---|---|---|---|
| 3,261,967 | 7/1966 | Rosin et al. | 348/94 |
| 4,465,952 | 8/1984 | Sato et al. . | |
| 4,643,579 | 2/1987 | Toriumi et al. | 348/95 |
| 4,643,688 | 2/1987 | Byerly et al. | 445/7 |
| 4,647,208 | 3/1987 | Bieman | 348/94 |
| 4,651,203 | 3/1987 | Peterson | 348/95 |
| 5,092,803 | 3/1992 | Johnson | 445/7 |
| 5,471,759 | 12/1995 | Burrows et al. | 33/567 |
| 5,478,265 | 12/1995 | Matsutani et al. | 445/7 |

FOREIGN PATENT DOCUMENTS

| | | | |
|---|---|---|---|
| 1072074 | 9/1954 | France | 445/7 |
| 54-029247 | 2/1979 | Japan . | |
| 59-000952 | 1/1984 | Japan . | |
| 3-064882 | 3/1991 | Japan . | |
| 7-57849 | 3/1995 | Japan . | |

OTHER PUBLICATIONS

Symposium of the Japanese Society for Quality Control, Jun. 21, 1988, pp. 12–16: see p. 15, Figure 11.

*Primary Examiner*—Robert Raevis

*Attorney, Agent, or Firm*—Cushman Darby & Cushman IP Group of Pillsbury Madison & Sutro LLP

[57] ABSTRACT

To improve the accuracy of the automatic adjustment of a spark plug and the adjustment of the eccentricity of a multiple-electrode spark plug, a spark plug holder 2 for supporting and fixing a lower portion of the multiple-electrode spark plug 1 and a positioning device 3 for supporting and positioning an upper portion of the multiple-electrode spark plug 1 are provided to an adjustor for automatically regulating the gap and the eccentricity of the multiple-electrode spark plug having a center electrode and at least one ground electrode. A projector 4 projects light to the multiple-electrode spark plug 1 from above the positioning device 3. A CCD camera 5 produces images of the spark gap/eccentricity of the multiple-electrode spark plug 1. An image processor 6 executes image processing for inputting the images from the CCD camera 5 and determining the spark gap/eccentricity. A hammering device 7 conducts a hammering operation for imparting a predetermined impact working pressure to the ground electrode on the basis of the spark gap/eccentricity. The image processing and the hammering operation are repeated until the spark gap/eccentricity are below predetermined values, respectively, so as to automatically regulate the spark gap/eccentricity.

13 Claims, 6 Drawing Sheets

ADJUSTMENT METHOD FOR SPARK PLUG AND APPARATUS THEREFOR

This is a continuation of application Ser. No. 08/563,821, filed on Nov. 28, 1995, which was abandoned upon the filing hereof.

BACKGROUND OF THE INVENTION

1. Field of the Invention

This invention relates to an automatic spark gap/eccentricity adjustor for a multiple-electrode spark plug.

2. Description of the Related Art

An example of an automatic spark gap/eccentricity adjustor for spark plugs is described in Japanese Unexamined Patent Publication (Kokai) No. 54-20247. This adjustor comprises a fixing device for fixing a spark plug, a gauge device, for measuring a spark gap, having a guide rod made of an insulator and having gauge pins so disposed therearound as to come into contact with the side surface of a center electrode, a detection circuit for electrically detecting any contact between the distal end surface of a ground electrode and the gauge pin, and a deformation device, for the ground electrode, utilizing a servo motor or the like.

However, this automatic adjustor involves a problem in that the spark gap size fluctuates due to machining and assembling accuracy of the spark gap/eccentricity automatic adjustor itself and to its vibration. Furthermore, because movement of the ground electrode due to flexibility is not constant, a high level of accuracy cannot be obtained. Still another problem lies in that, because the ground electrode must be deformed until it comes into contact with the gauge pin and generates a signal, force is applied to the guide rod made of an insulator, breaks the base portion of electrically insulating ceramics through the center electrode and eventually causes breakage of the spark plug itself.

SUMMARY OF THE INVENTION

In view of the problems described above, the present invention provides, in the following way, an adjustment method for a spark plug, and an apparatus therefor, which can minimize variance in spark gap size resulting from the accuracy of the adjustment itself and vibration, can improve accuracy resulting from nonuniform flexibility of a ground electrode, and can prevent breakage of an insulator by the force applied to a guide rod.

An adjustment method for a spark plug comprises the steps of supporting and fixing a spark plug having a center electrode and a ground electrode, executing image processing for determining a spark gap and/or an eccentricity by image signals obtained by imaging the spark gap and/or the eccentricity defined by the center electrode and the ground electrode, determining a hammering operation quantity providing an impact working pressure to the ground electrode in such a manner as to correspond to the spark gap and/or the eccentricity obtained from the image processing, imparting the impact working pressure to the ground electrode in accordance with the hammering quantity corresponding to the spark gap and/or the eccentricity, executing image processing for determining the spark gap and/or the eccentricity after the hammering operation by imaging the spark gap and/or the eccentricity after the hammering operation, and imparting again the impact working pressure to the ground electrode if the spark gap and/or the eccentricity obtained by the image processing does not reach a predetermined value.

Another adjustment method for a spark plug comprises the steps of supporting and fixing a spark plug having a center electrode and a ground electrode, executing image processing of image signals obtained by imaging a spark gap defined by the center electrode and the ground electrode and/or the eccentricity so as to determine the spark gaps and/or the eccentricity, conducting a hammering operation to impart an impact working pressure to the ground electrode on the basis of the spark gap and/or eccentricity obtained by the image processing, and executing image processing of image signals obtained by imaging the spark gaps and/or the eccentricity after the hammering operation so as to determine the spark gap and/or the eccentricity after the hammering operation.

An adjustor of a spark plug comprises spark plug holding means for holding a spark plug, imaging means for imaging a spark gap between a center electrode and a ground electrode of the spark plug and/or its eccentricity, image processing means for inputting an image from the imaging means and determining the spark gap and/or the eccentricity, and hammering means for conducting a hammering operation for imparting an impact working pressure to the ground electrode on the basis of the spark gap and/or the eccentricity to such an extent that the ground electrode does not come into contact with the center electrode, wherein the image processing and the hammering operation are repeated so as to regulate the spark gap and/or the eccentricity until the spark gap and/or the eccentricity is below a predetermined value.

According to the present invention, the image processing for determining the spark gap and/or eccentricity is executed, the impact working pressure is applied to the ground electrode on the basis of the spark gap/eccentricity, and the spark gap and/or eccentricity is automatically regulated until it falls below a predetermined value, and the spark gap and/or eccentricity is optically detected. Therefore, their minimum values can be easily detected, and since deformation of the ground electrode is caused by the impact working, movement due to flexibility is small, and the spark gap and/or eccentricity can be regulated very precisely. Since the center electrode is kept out of contact and the gauging of the prior art are not necessary, breakage of the spark plug itself is eliminated.

DESCRIPTION OF THE PREFERRED EMBODIMENT

Hereinafter, a preferred embodiment of the present invention will be explained with reference to the accompanying drawings.

Figure 1:
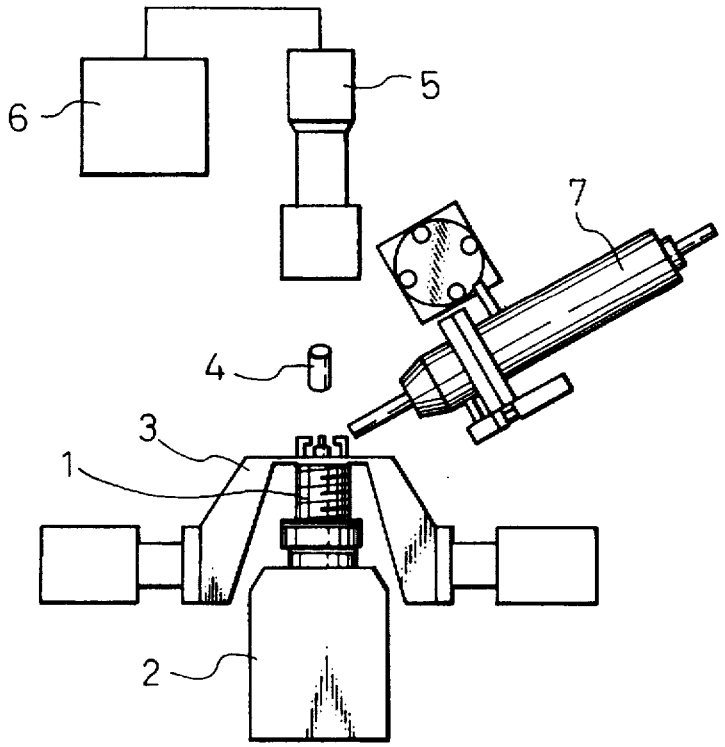
FIG. 1 is a schematic front view showing a spark gap/eccentricity automatic adjustor for a multiple-electrode spark plug according to an embodiment of the present invention.

FIG. 1 is a schematic front view showing an automatic spark gap/eccentricity adjustor for a multiple-electrode spark plug according to an embodiment of the present invention. The spark gap/eccentricity automatic adjustor of a multiple-electrode spark plug shown in the drawing comprises a multiple-electrode plug 1, a spark plug holder 2 as means for holding this multiple-electrode spark plug 1, a positioning device 3 for positioning the multiple-electrode spark plug 1 and fixing the same, a projector 4 for projecting light to the multiple-electrode spark plug 1, disposed at the side of the multiple-electrode spark plug 1, a charge coupled device camera (CCD camera) 5, for imaging the spark gap/the eccentricity of the multiple-electrode spark plug, disposed immediately above the multiple-electrode spark plug 1, an image processor 6 for processing image signals outputted from the CCD camera 5 and detecting the spark gap and the eccentricity, and a hammering device 7 as hammering means for automatically regulating the spark gap and the eccentricity. By the way, the CCD camera 5 is a TV camera with a built-in CCD area image sensor. Besides the CCD described above, imaging devices include a MOS (metal oxide semiconductor), a CID (charge injection device), and so forth, and the kind of the imaging device is not particularly limited.

Figure 2:
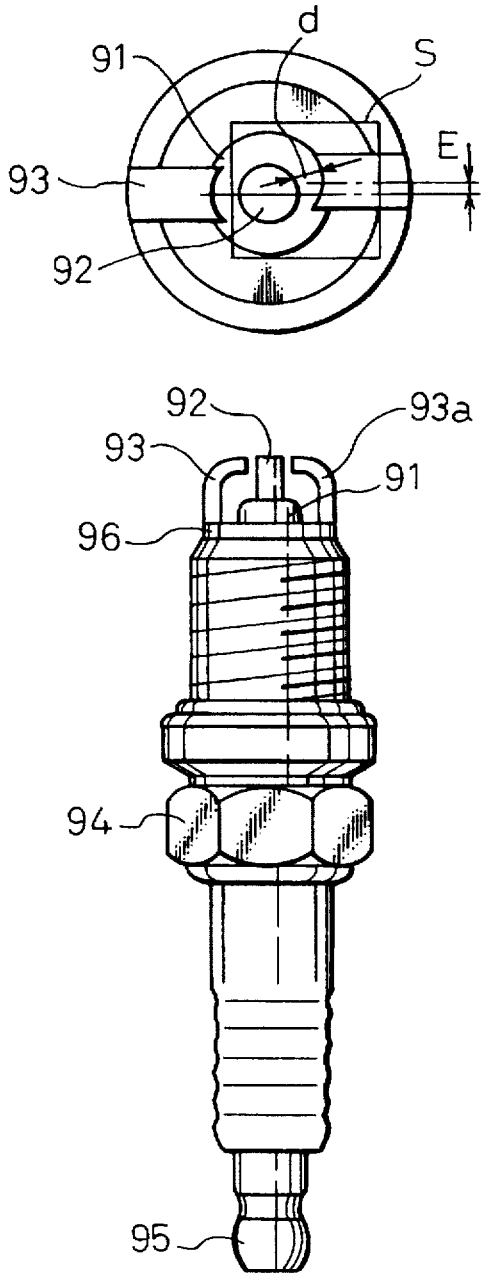
FIG. 2 is a schematic plan view showing a portion in the vicinity of the electrodes of the multiple-electrode spark plug 1.

FIG. 2 is a schematic plan view showing a portion in the vicinity of the electrodes of the multiple-electrode spark plug 1. As shown in the drawing, the multiple-electrode spark plug 1 has the shape of a short circular cylinder, and comprises a base portion 91 made of electrically insulating ceramic, a center electrode 92 protruding outward in the axial direction from the center of one of the ends of the base portion 91, L-shaped ground electrodes 93 the end portions of which encompasses the periphery of the center electrode 92 in such a manner as to define spark gaps with the side surfaces of the center electrode 92, a hexagonal portion 94 as the housing of the multiple-electrode spark plug 1, an upper stem 95 as the other end of the base portion 91, and a screw blind portion 96 of the multiple-electrode spark plug 1. The spark gaps between each side surface of the center electrode 92 of the multiple-electrode spark plug 1 and the end portions of the ground electrodes 93 are represented by d and the eccentricity, by E.

Here, the positioning device 3 supports the screw blind portion 96 from both sides as shown in FIG. 1.

The spark plug holder 2 supports the portion of the multiple-electrode spark plug 1 ranging from the hexagonal portion 94 of the housing of the multiple-electrode spark plug 1 to the upper stem 95. As shown further in FIG. 1, the optical axis of the CCD camera 5 exists at a position deviated by 1 mm towards the ground electrode 93 to be processed from the axis of the multiple-electrode spark plug 1. This arrangement is directed to precisely measure the spark gap/eccentricity and to process the two spark gaps one by one from one side. The spark gap d between the center electrode 92 and a ground electrode 93 of the multiple-electrode spark plug 1, and the eccentricity E, are imaged on the imaging surface S of the CCD camera 5 as shown in FIG. 2.

Further, the image processor 6 includes a general-purpose image processor, processes the image signals outputted from the CCD camera 5 in accordance with the later-appearing algorithm and extracts the minimum gap Dmin between the center electrode 92 and the ground electrode 93 or the eccentricity E.

Figure 3:
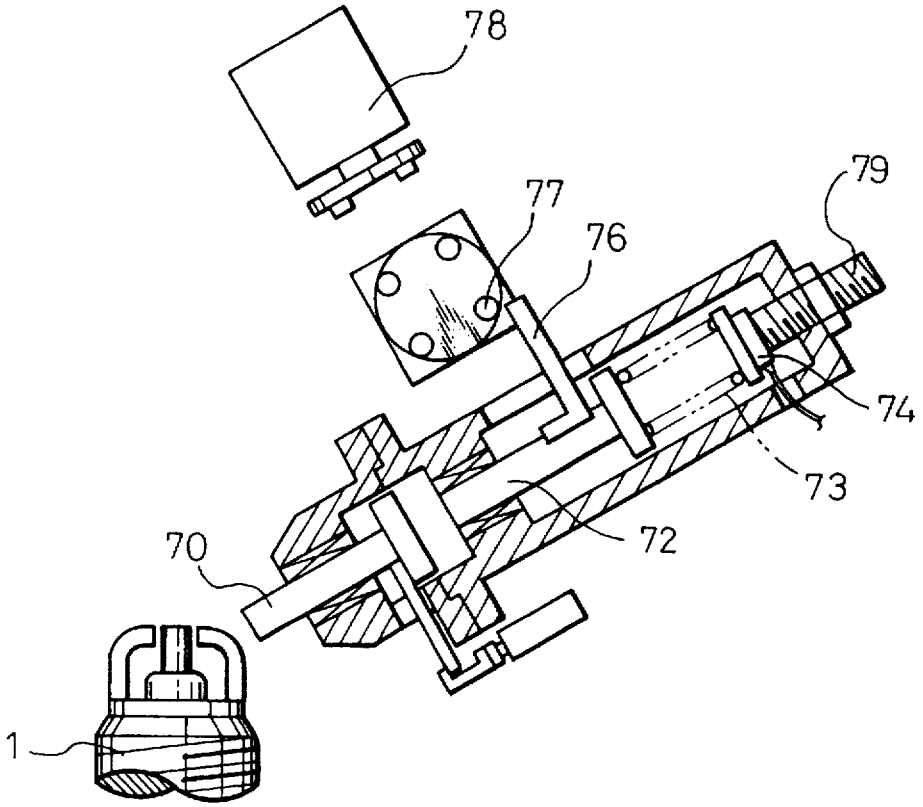
FIG. 3 is a perspective view showing an example of a hammering device 7, as shown in FIG. 1, for regulating the spark gap.

FIG. 3 shows the hammering device 7 of FIG. 1 which regulates the spark gap. As shown in this drawing, the hammering device 7 comprises a motor 78, a cam follower 77 fitted to a rotary plate provided to the output shaft of this motor 78, a pawl 76 disposed at a position at which it comes into contact with the cam follower 77, a first hammer 72 to which the pawl 76 is fixed, a spring 73 disposed at the back of the first hammer 72, a load convertor 74 disposed further at the back of the spring 73, for managing a working pressure, a set bolt 79 for regulating this working pressure, a second hammer 70 positioned in front of the first hammer 72, and a cylinder for moving back the second hammer 70 at the time of imaging or installation of the multiple-electrode spark plug 1, that is, for moving back the second hammer 70 by a pin protruding from the second hammer 70. Further, the direction of the second hammer 70 of this hammering device 7 is so set as to impart impact working to the bent portion 93*a* of an L-shaped ground electrode 93 of the multiple-electrode spark plug 1. By the way, the hammering device 7 may be directly driven by an air cylinder, etc., in place of the motor 78, and the working direction, that is, the angle of the hammering device 7, may also be changed.

Figure 4:
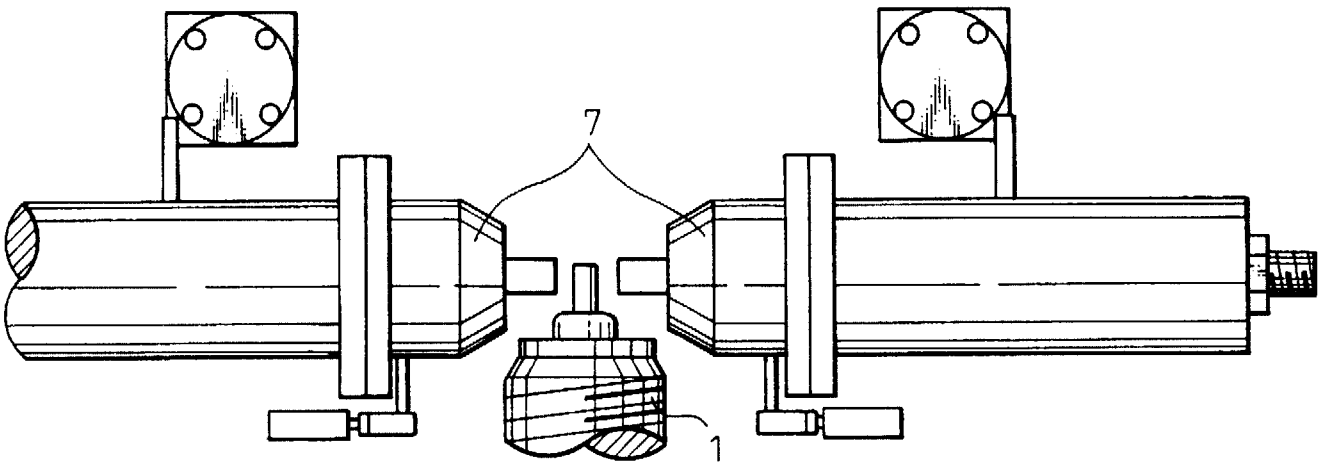
FIG. 4 is a schematic view showing an example of a hammering device 7, as shown in FIG. 1, for regulating eccentricity.

FIG. 4 shows an example of the hammering device 7 of FIG. 1 which executes eccentricity adjustment. As shown in the drawing, two hammering devices 7 are disposed on both sides of the multiple-electrode spark plug 1 when eccentricity adjustment is carried out.

Figure 5:
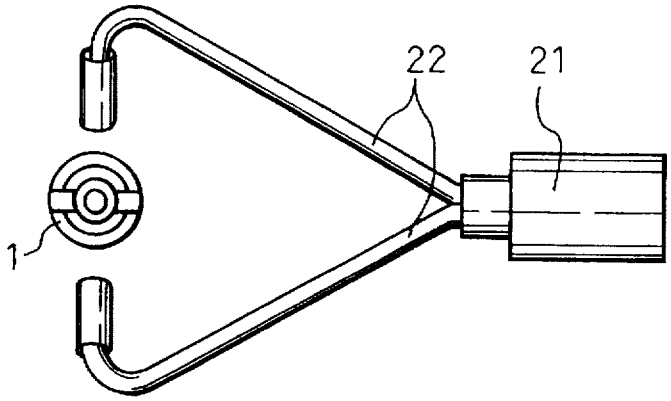
FIG. 5 is a schematic plan view showing a projector 4 shown in FIG. 1.

FIG. 5 is a schematic plan view showing the projector 4 of FIG. 1. As shown in the drawing, the projector 4 comprises an illumination device 21 and a light guide 22 made of an optical fiber extending from the illumination device 21, and projects continuous light at an angle of inclination of approximately 30°.

Next, the operation of the spark gap/eccentricity automatic adjustor of the multiple-electrode spark plug will be explained. First, the multiple-electrode spark plug 1 is fitted from above into the recess of the spark plug holder 2. Next, when a start button is pushed, a series of routines are started. In other words, the projector 4 projects light and the CCD camera 5 images the portion in the vicinity of both electrodes 92, 93. In this embodiment, the center electrode 92 and the ground electrode 93 are imaged as black while the insulating base portion 91 is imaged as white. Accordingly, the portion between both electrodes 92 and 93, that is, the spark gap, has the length of the white color portion. The image processor 6 extracts the minimum spark gap Dmin and examines whether or not Dmin so extracted is greater than a target gap value DC that is set in advance. If it is found greater, the processor then examines at which level of a set or pre-set levels the extracted Dmin value exists.

Figure 6:
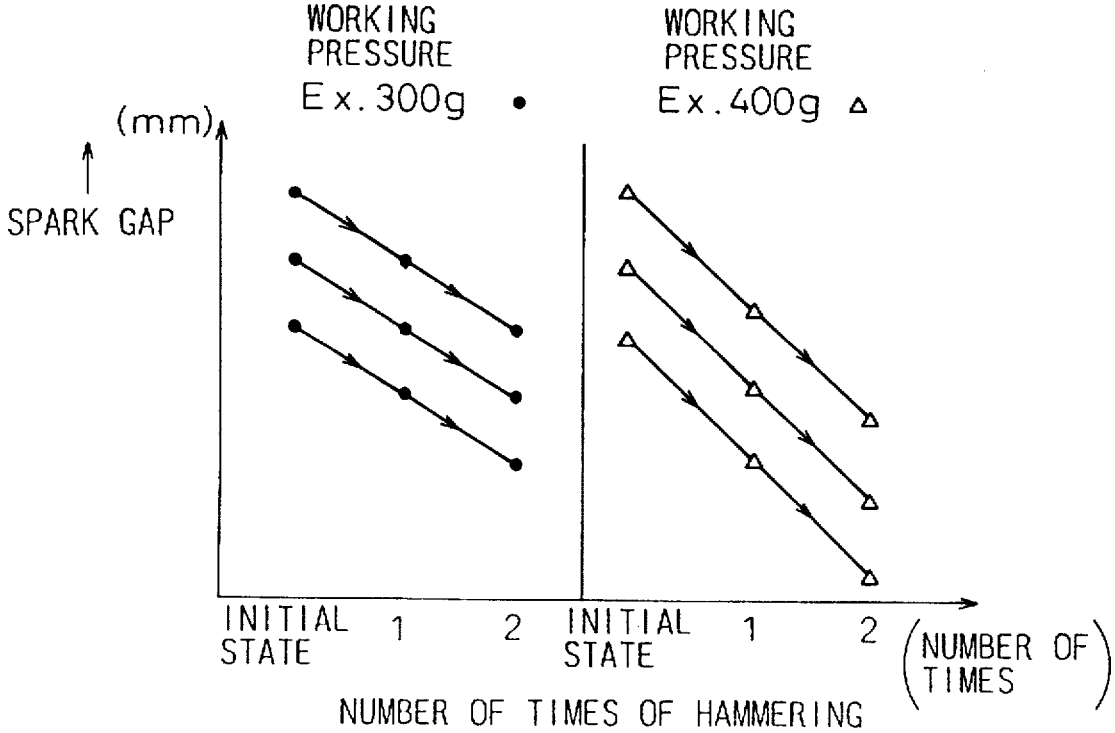
FIG. 6 is a diagram showing an experimental example of the relationship between a spark gap and the number of times of hammering.

FIG. 6 is a diagram showing an experimental example of the relation between the spark gap and the number of times of hammering. As shown in the diagram, the relation between the spark gap and the number of times of hammering can be determined by using a working pressure as a parameter, and a predetermined working displacement can be obtained. It can be therefore understood that the present invention contributes to precision and efficient adjustment of the spark gap and also to the management and the ease of the operation. As a result of the level examination described above, the number of times of hammering by the hammering device 7 is set in advance on the basis of the experiment shown in the diagram, and the motor 78 is rotated in accordance with the number of times of hammering. In consequence, the cam follower 77 rotates and the pawl 76 and the first hammer move back and forth, so that the spring force is applied to the second hammer 70 and the furthermore, the force is applied to the ground electrode 93.

When Dmin becomes below the target gap value Dc in the course of repetition of this routine, the processing is completed.

On the other hand, eccentricity adjustment is carried out in the following way. First, the center is determined from the edges of the center electrode 92 and the ground electrode, and the difference of coordinates is extracted as eccentricity E. Next, whether or not this eccentricity E is greater than a target eccentricity value Ec, which is set in advance, is examined. If it is found greater, at which level of a set of preset levels this eccentricity E exists is examined. The number of times of hammering is also set in accordance with this level, and thereafter the operation is carried out in the same way as described above. When eccentricity E becomes below the target eccentricity value Ec, the operation is completed. Next, the relation between the processing by the image processor and the hammering operation by the hammering device 7 will be explained in detail.

Figure 7:
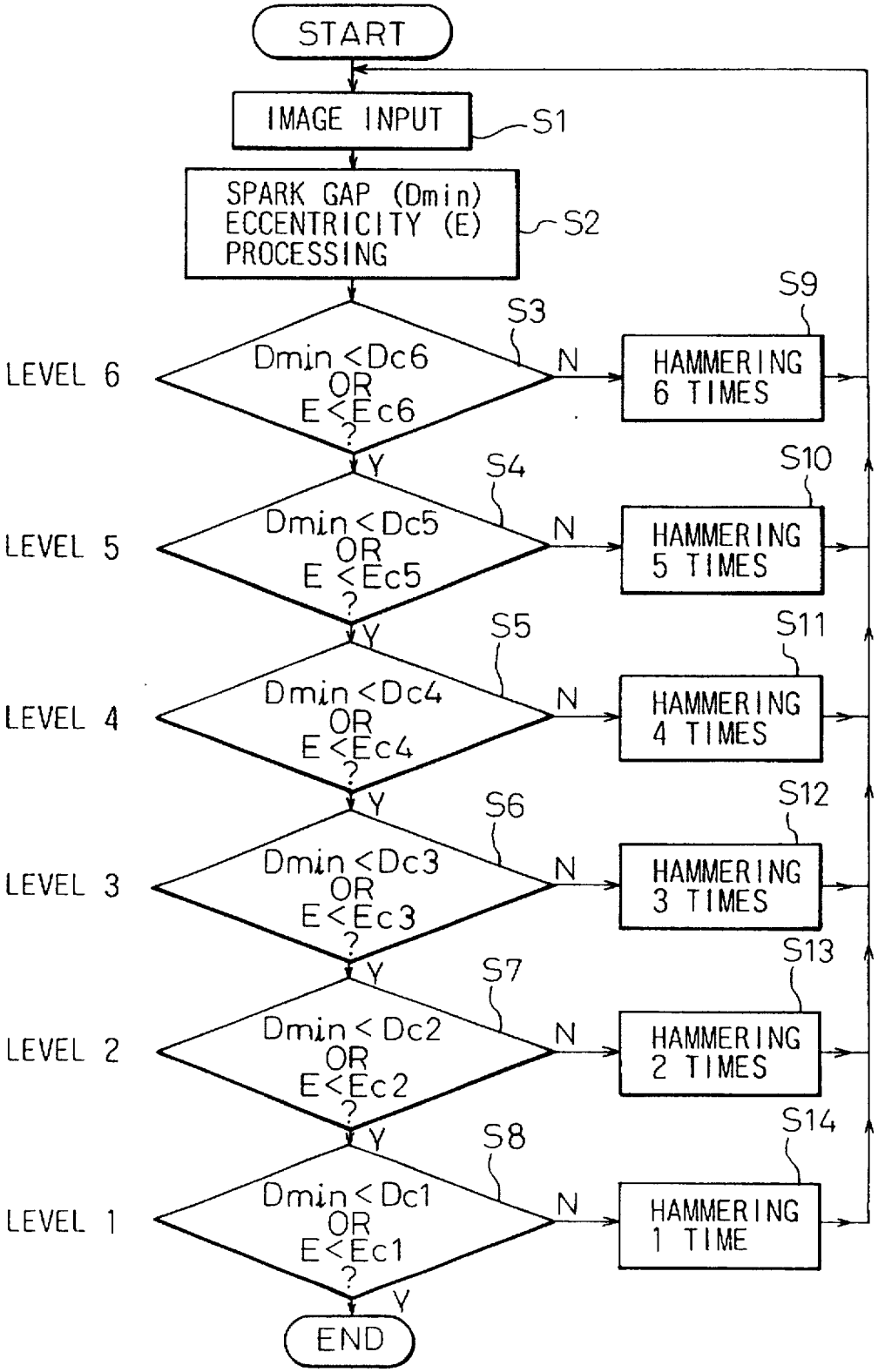
FIG. 7 is a flowchart useful for explaining the relation between the processing in an image processor 6 and the hammering of the hammering device 7.

FIG. 7 is a flowchart useful for explaining the relation between the processing of the image processor 6 and hammering by the hammering device 7.

At step S1, the image processor 6 inputs the image data.

At step S2, the spark gap (Dmin) and eccentricity (E) are processed. Here, the target gap values Dc1, Dc2, Dc3, Dc4, Dc5 and Dc6 (Dc1<Dc2<Dc3<Dc4<Dc5<Dc6) and target eccentricity values Ec1, Ec2, Ec3, Ec4, Ec5 and Ec6 (Ec1<Ec2<Ec3<Ec4<Ec5<Ec6) are set as values of the levels 1 to 6, respectively.

At step S3, whether or not the relation Dmin<Dc6 or E<Ec6 is established for the level 6 is judged. If the result proves "YES", the flow proceeds to step S4 and if it proves "NO", the flow proceeds to step S9.

At step S4, whether or not the relation Dmin<Dc5 or E<Ec5 is established for the level 5 is judged. If the result proves "YES", the flow proceeds to step S5 and if it proves "NO", the flow proceeds to step S10.

At step S5, whether or not the relation Dmin<Dc4 or E<Ec4 is established for the level 4 is judged. If the result proves "YES", the flow proceeds to step S6 and if it proves "NO", the flow proceeds to step S11.

At step S6, whether or not the relation Dmin<Dc3 or E<Ec3 is established for the level 3 is judged. If the result proves "YES", the flow proceeds to step S7 and if it proves "NO", the flow proceeds to step S12.

At step S7, whether or not the relation Dmin<Dc2 or E<Ec2 is established for the level 2 is judged. If the result proves "YES", the flow proceeds to step S8 and if it proves "NO", the flow proceeds to step S13.

At step S8, whether or not the relation Dmin<Dcl or E<Ec1 is established for the level 1 is judged. If the result proves "YES", the processing is completed and if it proves "NO", the flow proceeds to step S14.

At step S9, the number of times of hammering of the hammering device 7 is set to 6 (times) and then the flow returns to step S1.

At step S10, the number of times of hammering of the hammering device 7 is set to 5 (times) and then the flow returns to step S1.

At step S11, the number of times of hammering of the hammering device 7 is set to 4 (times) and then the flow returns to step S1.

At step S12, the number of times of hammering of the hammering device 7 is set to 3 (times) and then the flow returns to step S1.

At step S13, the number of times of hammering of the hammering device 7 is set to 2 (times) and then the flow returns to step S1.

At step S14, the number of times of hammering of the hammering device 7 is set to 1 (time) and then the flow returns to step S1.

Next, the advantages of the spark gap/eccentricity automatic adjustor of the multiple-electrode spark plug according to this embodiment will be explained.

First, this embodiment does not employ compression working which utilizes a servo motor, etc., and has been used in the past, for the ground electrode, but employs impact working which utilizes a spring. In other words, because the hammering device 7 conducts impact working of the ground electrode, it does not come into contact with the center electrode, and movement due to the flexibility of the ground electrode can be made extremely small. Because the load convertor manages the working pressure, an arbitrary working pressure, that is, the working quantity (displacement quantity) of the ground electrode can be obtained. According to the prior art, the spark gap/eccentricity can be confirmed by a detection circuit during elastic compression, but it has been necessary to make confirmation with eye after the elastic return. When this elastic return is not uniform, high accuracy cannot be obtained, and the operation must be carried out again and again, so that the working factor is low. In contrast, according to the present invention, the spark gap/eccentricity can be optically measured after the impact working as such. Therefore, high accuracy can be secured, and working efficiency can be improved. Namely, the spark gap/eccentricity of the multiple-electrode spark plug can be regulated highly precisely and efficiently. Because the gauge pin that has been used in the past becomes unnecessary, the base portion 91 of the multiple-electrode spark plug is now free from breakage.

Second, the number of times of hammering is set stepwise in accordance with the Dmin value in this embodiment. Therefore, the number of times of hammering is great when the Dmin value is great, and is small when the latter is small. Therefore, working efficiency can be improved.

Third, the set bolt 79 is disposed at the back of the spring 73, and the hammering pressure can be set to an arbitrary level by changing the spring force. When the spark gap is great, the spring is arbitrarily compressed so as to increase the hammering pressure. Accordingly, working efficiency can be improved.

As described above, the present invention detects the spark gap/eccentricity optically and can easily detect their minimum values. Further, since the present invention causes deformation of the ground electrode by impact working, the movement due to flexibility is small, and the spark gap/eccentricity can be regulated very precisely. Breakage of the multiple-electrode spark plug itself due to the automatic adjustor, as has been observed in the prior art, is now eliminated.

We claim:

1. An adjustment method for a spark plug, comprising the steps of:

supporting and fixing a spark plug having a center electrode and ground electrodes;

executing an image processing of image signals obtained by imaging a spark gap defined by said center electrode and said ground electrodes and/or eccentricity so as to determine said spark gap and/or said eccentricity;

determining a hammering operation quantity providing an impact working pressure several times to said ground electrodes in such a manner as to correspond to said spark gap and/or said eccentricity obtained by said image processing;

imparting an impact working pressure several times to said ground electrodes in accordance with said hammering operation quantity corresponding to said spark gap and/or said eccentricity;

executing an image processing of image signals obtained by imaging said spark gap and/or said eccentricity after said hammering operation so as to determine said spark gap and/or said eccentricity after said hammering operation; and imparting again said impact working pressure to said ground electrode when said spark gap and/or said eccentricity obtained by said image processing does not reach a predetermined value, wherein said ground electrode has a bent portion so formed as to extend from one of the ends thereof to the other and said hammering operation imparts an impact working pressure directly to said bent portion.

2. An adjustment method for a spark plug according to claim 1, wherein said spark plug is a multiple-electrode spark plug comprising a center electrode held by an insulator, a housing for holding said insulator, and ground electrodes fixed at one of the both ends thereof to said housing, having the other end thereof opposing the side surface of said center electrode to thereby form said spark gap.

3. An adjustment method for a spark plug, comprising the steps of:

supporting and fixing a spark plug having a center electrode and a ground electrode;

executing an image processing of image signals obtained by imaging a spark gap defined by said center electrode and said ground electrode and/or eccentricity so as to determine said spark gap and/or said eccentricity;

conducting a hammering operation to impart an impact working pressure to said ground electrode on the basis of said spark gap and/or said eccentricity obtained by said image processing; and executing an image processing of image signals obtained by imaging said spark gap and/or said eccentricity after said hammering operation so as to determine said spark gap and/or said eccentricity after said hammering operation, wherein said hammering operation is carried out a plurality of times until said spark gap and/or said eccentricity reaches a predetermined value, and wherein said ground electrode has a bent portion so formed as to extend from one of the ends thereof to the other and said hammering operation imparts an impact pressure directly to said bent portion.

4. An adjustment method for a spark plug according to claim 3, wherein said spark plug is a multiple-electrode spark plug comprising a center electrode held by an insulator, a housing for holding said insulator, and ground electrodes fixed at one of the ends thereof to said housing, having the other end thereof opposing the side surface of said center electrode to thereby form said spark plug.

5. An adjustor of a spark plug comprising:

spark plug holding means for holding a spark plug;

imaging means for imaging a spark gap between a center electrode and a ground electrode of said spark plug and/or its eccentricity;

image processing means for inputting an image from said imaging means and determining said spark gap and/or said eccentricity; and hammering means for conducting a hammering operation for imparting an impact working pressure to said ground electrode on the basis of said spark gap and/or said eccentricity to such an extent that said ground electrode does not come into contact with said center electrode;

means for repeatedly implementing the image and hammering means so as to regulate said spark gap and/or said eccentricity until said spark gap and/or said eccentricity is below a predetermined value; and wherein said hammering operation is carried out a plurality of times until said spark gap and/or said eccentricity reaches the predetermined value, and wherein said ground electrode has a bent portion so formed as to extend from one of the ends thereof to the other and said hammering operation imparts an impact working pressure directly to said bent portion.

6. An adjustor of a spark plug according to claim 5, wherein said spark plug is a multiple-electrode comprising a center electrode held by an insulator, a housing for holding said insulator, and at least one ground electrode fixed at one of the ends thereof to said housing, having the other end thereof opposing the side surface of said center electrode to thereby form said spark plug.

7. An adjustor of a spark plug according to claim 5, which further comprises a hammering operation quantity determination means for determining said hammering operation quantity in such a manner as to correspond to said spark gap and/or said eccentricity obtained by said image processing means, and wherein said hammering operation by said hammering means is carried out on the basis of the hammering operation quantity determined by said hammering operation quantity determination means.

8. An adjustor of a spark plug according to claim 5, wherein said hammering means is driven by a motor, includes a load convertor for managing said impact working pressure, and sets said impact working pressure to an arbitrary value.

9. An adjustor of a spark plug according to claim 5, wherein said hammering means is directly driven by an air cylinder.

10. An adjustor of a spark plug according to claim 5, wherein a number of times said hammering operation is carried out is set in advance depending on target gap values and/or target eccentricity values and said number of times said hamering operation is carried out is determined by comparing said target gap values and/or said target eccentricity values with said spark gap and/or said eccentricity.

11. An adjustment method for a spark plug comprising the steps of:

supporting and fixing a spark plug having a center electrode and ground electrodes;

executing an image processing of image signals obtained by imaging a spark gap defined by said center electrode and said ground electrodes and/or eccentricity so as to determine said spark gap and/or said eccentricity;

determining a hammering operation quantity providing an impact working pressure several times to said ground electrodes in such a manner as to correspond to said spark gap and/or said eccentricity obtained by said image processing;

imparting an impact working pressure several times to said ground electrodes in accordance with said hammering operation quantity corresponding to said spark gap and/or said eccentricity;

executing an image processing of image signals obtained by imaging said spark gap and/or said eccentricity after said hammering operation so as to determine said spark gap and/or said eccentricity after said hammering operation; and imparting again said impact working pressure to said ground electrode when said spark gap and/or said eccentricity obtained by said image processing does not reach a predetermined value, wherein said ground electrode has a bent portion so formed as to extend from one of the ends thereof to the other and said hammering operation imparts an impact working pressure to only said bent portion.

12. An adjustment method for a spark plug comprising the steps of:

supporting and fixing a spark plug having a center electrode and a ground electrode;

executing an image processing of image signals obtained by imaging a spark gap defined by said center electrode and said ground electrode and/or eccentricity so as to determine said spark gap and/or said eccentricity;

conducting a hammering operation to impart an impact working pressure to said ground electrode on the basis of said spark gap and/or said eccentricity obtained by said image processing; and executing an image processing of image signals obtained by imaging said spark gap and/or said eccentricity after said hammering operation so as to determine said spark gap and/or said eccentricity after said hammering operation, wherein said hammering operation is carried out a plurality of times until said spark gap and/or said eccentricity reaches a predetermined value, and wherein said ground electrode has a bent portion so formed as to extend from one of the ends thereof to the other and said hammering operating imparts an impact pressure to only said bent portion.

13. An adjustor of a spark plug comprising:

spark plug holding means for holding a spark plug;

imaging means for imaging a spark gap between a center electrode and a ground electrode of said spark plug and/or its eccentricity;

image processing means for inputting an image from said imaging means and determining said spark gap and/or said eccentricity; and hammering means for conducting a hammering operation for imparting an impact working pressure to said ground electrode on the basis of said spark gap and/or said eccentricity to such an extent that said ground electrode does not come into contact with said center electrode;

means for repeatedly implementing the image and hammering means so as to regulate said spark gap and/or said eccentricity until said spark gap and/or said eccentricity is below a predetermined value; and wherein said hammering operation is carried out a plurality of times until said spark gap and/or said eccentricity reaches the predetermined value, and wherein said ground electrode has a bent portion so formed as to extend from one of the ends thereof to the other and said hammering operation imparts an impact working pressure to only said bent portion.

* * * * *